US006497132B1

(12) United States Patent
Mackay et al.

(10) Patent No.: US 6,497,132 B1
(45) Date of Patent: Dec. 24, 2002

(54) FLARING DIE WITH STRESS RELIEF FEATURES

(75) Inventors: Gary Mackay, Ancaster (CA); Mel LeBlanc, Mount Hope (CA)

(73) Assignee: Tube-Mac Industries, Ltd., Ontario (CA)

( * ) Notice: Subject to any disclaimer, the term of this patent is extended or adjusted under 35 U.S.C. 154(b) by 0 days.

(21) Appl. No.: 09/927,159

(22) Filed: Aug. 10, 2001

(51) Int. Cl.[7] ..... B21D 41/02
(52) U.S. Cl. ..... 72/318; 72/316
(58) Field of Search ..... 72/317, 318, 316, 72/118, 125, 370.1, 370.11

(56) References Cited

U.S. PATENT DOCUMENTS

| | | | | |
|---|---|---|---|---|
| 1,291,646 A | | 1/1919 | Hughes | |
| 1,754,637 A | * | 4/1930 | McGough | 72/318 |
| 2,241,091 A | | 5/1941 | Hood | |
| 2,563,088 A | * | 8/1951 | Wilks | 24/524 |
| 2,774,408 A | | 12/1956 | Franck | |
| 3,083,755 A | * | 4/1963 | Wilson | 72/317 |
| 3,103,245 A | | 9/1963 | Iskyan | |
| 3,109,479 A | | 11/1963 | Wolcott | |
| 3,466,707 A | | 9/1969 | Click et al. | |
| 3,610,016 A | | 10/1971 | Bultman | |
| 4,104,902 A | * | 8/1978 | Cease | 72/117 |
| 4,127,021 A | | 11/1978 | Johnson | |
| 4,779,441 A | | 10/1988 | Pringle | |
| 4,905,492 A | | 3/1990 | Lobakk | |
| 5,518,275 A | | 5/1996 | Mackay | |
| 5,823,579 A | | 10/1998 | Mackay | |

FOREIGN PATENT DOCUMENTS

| | | |
|---|---|---|
| DE | 2 147 232 | 3/1993 |

* cited by examiner

*Primary Examiner*—Daniel C. Crane
(74) *Attorney, Agent, or Firm*—Buchanan Ingersoll, P.C.

(57) ABSTRACT

A pipe flaring die has a central opening with a profile configured to reduce stress concentrations at the base of the flared portion of the pipe. The profile includes an annular relief area intermediate an annular gripping surface and an annular beveled portion which defines the angle of the flared portion. The relief area provides a longer transition distance for the formation of the flared portion which results in a reduced residual stress concentration created at the base of the flared portion during the forming process.

18 Claims, 7 Drawing Sheets

FLARING DIE WITH STRESS RELIEF FEATURES

BACKGROUND

This invention relates generally to dies for flaring and/or coupling pipe ends, and more particularly, to such a flaring die configured to reduce stress concentration at the base of the flange created by the flaring die.

Pipes and tubing are used to carry a variety of fluids, some are liquids and others are gases. These fluids may be under substantial pressures or at standard pressure. Therefore, pipes and tubing are rated according to the fluid pressures which the conduit can carry without rupturing. A particular conduit is considered to be a pipe or tubing depending upon the wall thickness of the conduit, the industry or application in which it is being used, and sometimes upon whether it is plastic or metal. For present purposes and simplicity the term pipe will be used to encompass both pipe and tubing as those terms are used by those skilled in the art.

In hydraulic connections it is quite common to utilize pipes in which the end of the pipe has been flared to form a collar which is placed to abut against a surface of the device to which the pipe is being connected, or against another flared pipe often with a sealing ring between them. In order to create the flared end or collar it is customary to provide a clamping die which is pressed against the pipe to be flared at a specified distance away from the end of the pipe. This die typically will have a gripping surface containing teeth or threads which bite into the exterior surface of the pipe being held. The die is pressed against the end of the pipe to hold the pipe during flaring. The flaring process is usually performed by a flaring machine having an eccentric cone. The eccentric cone is pressed against the end of the pipe and rotated circumferentially about the end of the pipe to form a flare. The flare can be at any angle relative to the side of the pipe. The pipe flaring practice is quite old, but there have been improvements in the flaring tools. An improved flaring tool and method of using the same for forming a transverse collar on the end of the metal pipe is disclosed in U.S. Pat. No. 4,905,492.

A conventional flaring die comprises two members which are clamped over the pipe near the end to be flared. Each die member has a central semi-circular opening which is placed over the pipe to be flared. The die members are clamped together near the end of the pipe which is going to be flared. The opening through the die members is sized such that the pipe is of slightly larger diameter than the opening so that the pipe is rigidly gripped between the die members. When the die is closed, the teeth or threads on the gripping surface bite into the pipe creating a series of cuts or grooves on the outside of the pipe. Also, the die members have an annular beveled portion, angled outwardly from the gripping surface. The end of the pipe to be flared is pressed against the beveled portion by the eccentric cone to create the flare. The angle of the beveled portion determines the angle of the flared portion of the pipe. During flaring a stress concentration is created at the base of the flared portion. Because the threads of the gripping portion extend to the edge of the annular beveled portion there are cuts or grooves near the base of the flared portion. These cuts create stress risers. Prior to the present invention those skilled in the art did not recognize that such stress risers had been created or if they had recognized their existence, such skilled artisans did not understand their significance. This stress concentration negatively affects the life and usefulness of the pipe, and the joint of which the flared end of the pipe is a member.

We observed that certain couplings made with flared pipes failed in a high pressure system. One of the pipes cracked at the base of the flare. We believe that the crack occurred during a pressure spike in the system. Consequently, we saw a need for a flared pipe that would not crack when exposed to pressure spikes. One obvious solution to this problem is to use a thicker pipe or a pipe made from a stronger alloy. Not only are those solutions more expensive, they also are not practical for many applications.

A better solution is to find a way to make a flared pipe having lower stress at the base of the pipe than the same pipe made in the conventional way. A flaring die which is configured to reduce the stress concentration at the base of the flared portion would increase the life of and reduce limitations on the pipe and the joint of which it is a part.

Another problem encountered with conventional flaring dies is positioning the pipe in the die so that the flare is of a desired length. If one simply places the pipe so that the end of the pipe is in the same plane as the face of a conventional die the flare will not extend the full width of the beveled portion. If the pipe extends too far beyond that plane the flare will extend beyond the beveled portion. One solution to the problem is to first determine the correct distance from the end of the pipe where the pipe must be gripped. Then the pipe fitter makes a mark on the pipe at that distance and inserts the pipe into the die until the mark is aligned with the insertion side of the die. Another approach is to make and attach a jig or stop to the die against which the pipe can be placed. Using a jig or stop saves time but adds cost. A better solution would be to design the die to have an alignment guide as part of the die.

SUMMARY

We provide a pipe flaring die having a profile configured to reduce stress concentrations at the base of the flared portion of the pipe. The flaring die typically is two arch-shaped members which are clamped around the wall of the pipe to be flared. Each member has a profile which includes a relief area provided between a gripping surface and an annular beveled portion. The gripping surface aids in rigidly holding the pipe while the flared end is formed. The annular beveled portion defines the angle of the flared portion that is created by deforming the end of the pipe outward against the annular beveled portion of the die members. Unlike the dies of the prior art we provide a relatively wide relief area between the gripping surface and the beveled portion. For, example in a flaring die for a two inch pipe the width of the die is 1.625 inches wide, the gripping surface is 0.655 inches wide and the relief area is 0.475 inches wide. Indeed, we prefer that the width of the relief area be about two-thirds of the width of the gripping surface. When a pipe is held by our die the grooves or cuts made in the outer surface of the pipe while the die was gripping the pipe during flaring are spaced apart from the based of the flare. The relief area provides a longer transition distance for the formation of the flared portion. This results in a reduction in the residual stress concentrated in the region of the pipe at the base of the flared portion. Additionally, the edge between the relief area and the annular beveled portion can be provided with a radius which further reduces the residual stress concentration at the base of the flared portion.

We further prefer to provide a recess between the edge of the beveled portion and the face of the die that serves as an alignment guide. The pipe fitter places a ruler or other straight edge across the face of the die and inserts the pipe until the pipe abuts the straight edge.

A further feature according to the invention is that mating surfaces of each die member can be provided with a recessed area that can be externally accessed by a tool to separate the clamped together die members after the flaring process is completed.

Other objects and advantages of the invention will become apparent from a description of certain preferred embodiments shown in the drawings.

BRIEF DESCRIPTION OF THE DRAWINGS

A more complete understanding of the invention can be obtained by considering the following detailed description in conjunction with the accompanying drawings, in which.

DESCRIPTION OF THE PREFERRED EMBODIMENTS

Figure 1:
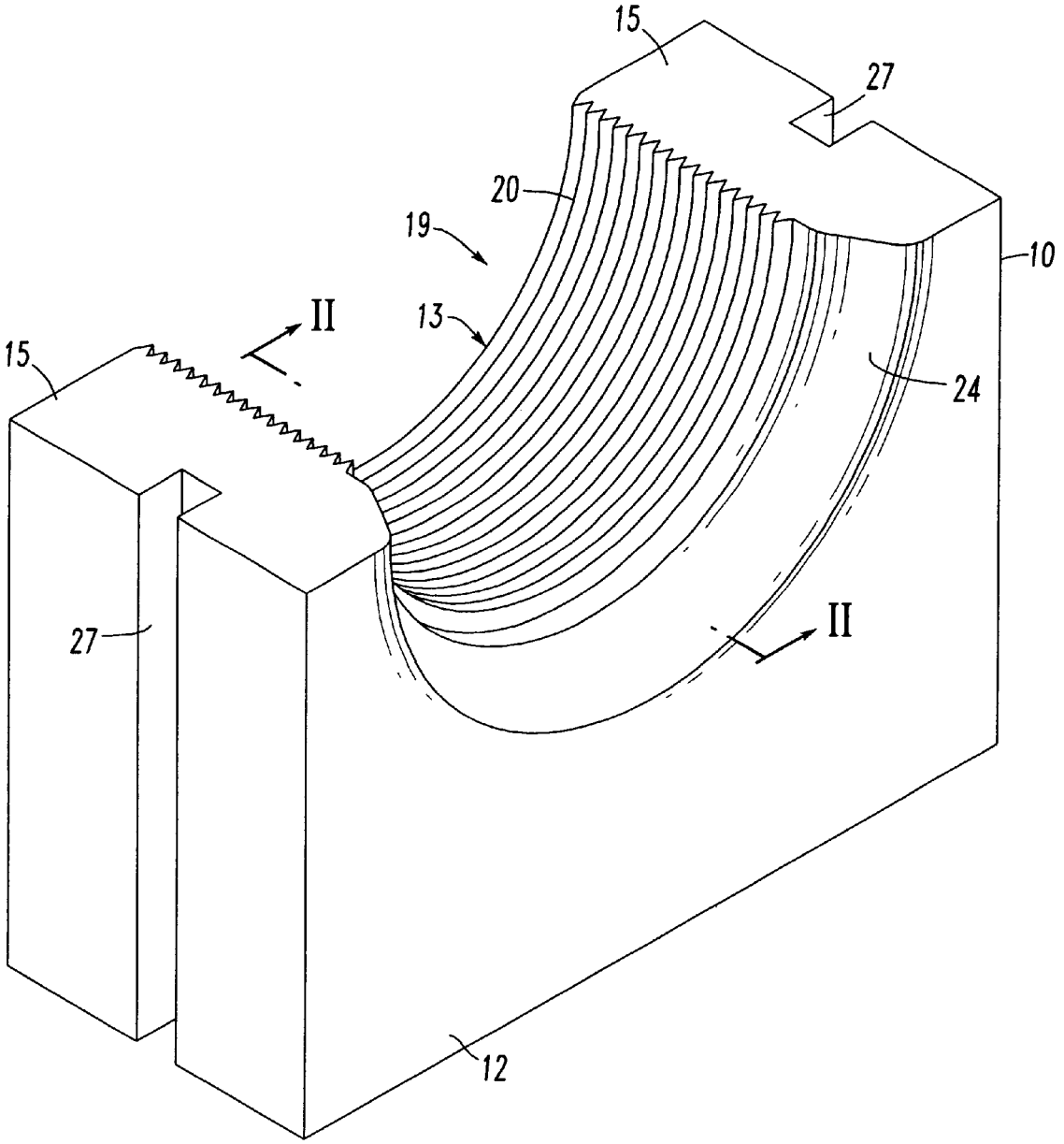
FIG. 1 PRIOR ART
FIG. 1 is a perspective view of a portion of a prior art flaring die.
Figure 2:
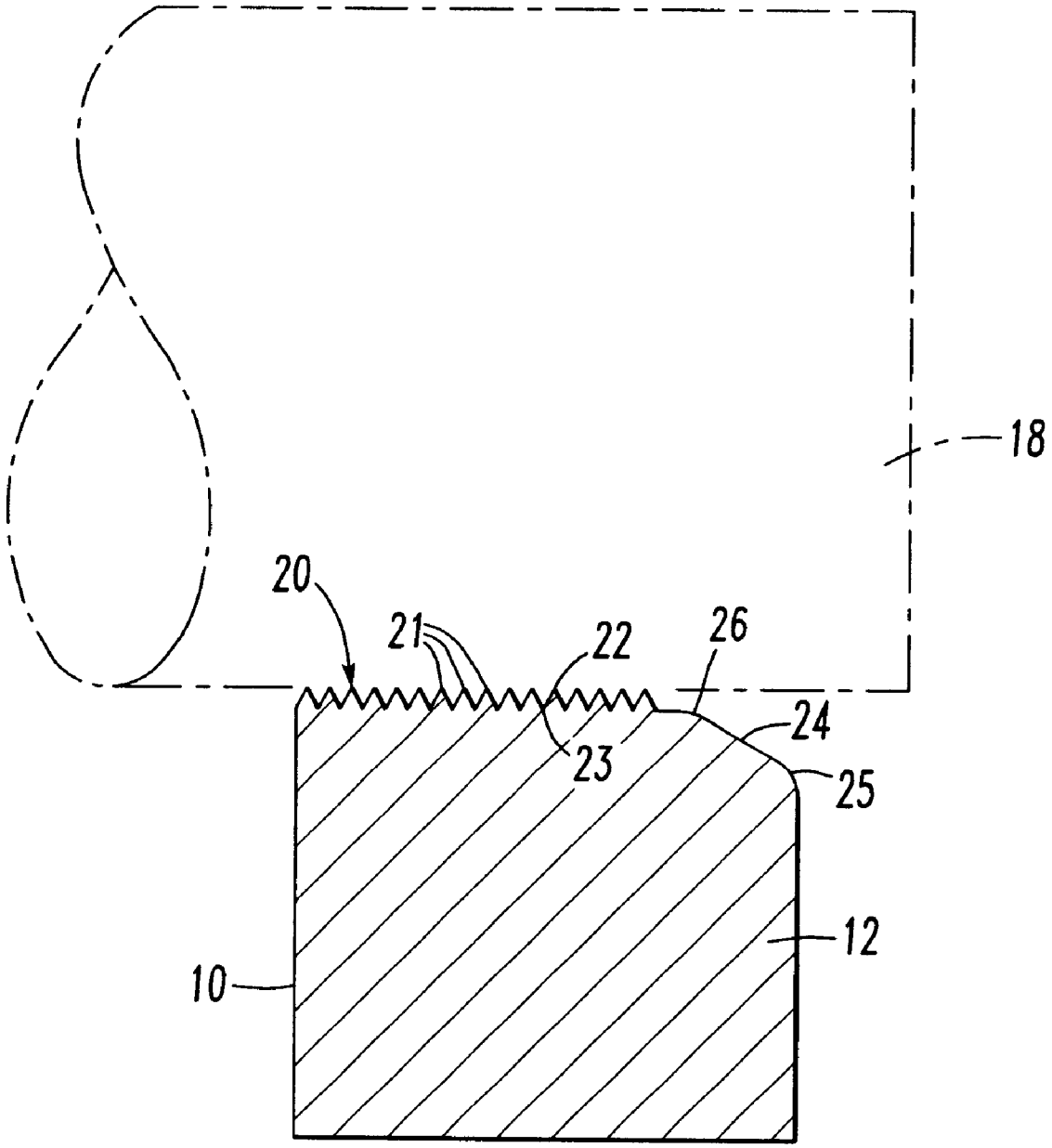
FIG. 2 PRIOR ART
FIG. 2 is a sectional view taken along the line II—II in FIG. 1 with a portion of pipe shown in chain line.
Figure 3:
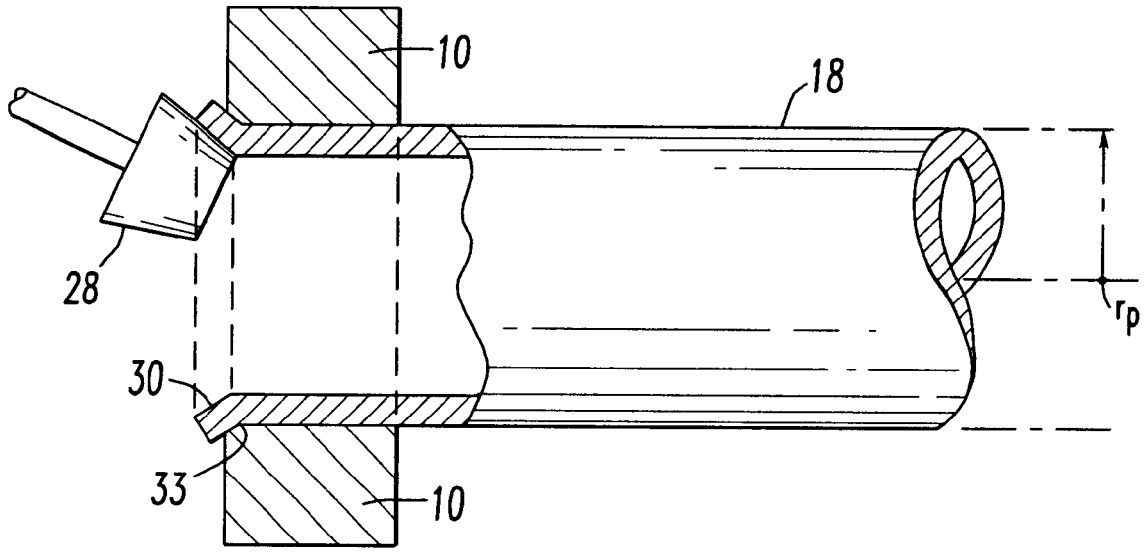
FIG. 3 PRIOR ART
FIG. 3 is a sectional view illustrating generally a process for flaring the end of a pipe.

A conventional flaring die member 10, is illustrated in FIGS. 1 and 2. In use, a pair of arch-shaped die members 10 are clamped together about the pipe 18 which is to be flared, as shown in FIG. 3. For purposes of this description however, only one die member 10 shall be described since the second die member is simply a mirror image of the first. Conventionally, each die member 10 has a central, semi-circular opening 19 between two shoulders 15. When the two die members are clamped together the shoulders of the die members abut one another. Consequently, there is a generally circular opening between the two die members which receives the pipe 18 to be flared. Two die members 10 are placed in a clamping device (not shown), which can use the slots 27 in the sides of each die member to clamp the die members in proper alignment. The two die members 10 are clamped together near the end of the pipe 18 which is going to be flared. The semi-circular opening 19 in each die member 10 has a radius which is sized to be slightly smaller than the radius of the pipe 18 so that the pipe is rigidly gripped when the die members 10 are clamped together around the pipe 18. The surface 13 of the die surrounding the semi-circular opening 19 includes an annular gripping surface 20 having raised ridges, threads, or like projections 21. Those projections bite into the wall of the pipe 18 to hold the pipe 18 stationary during the flaring process. The ridges, threads or other projections 21 on the annular gripping surface 20 inherently define a minor diameter at the tip 22 of a ridge or thread, and a major diameter at the base 23 of a ridge or thread. The minor diameter is that which generally corresponds to the radius of the central opening that is sized slightly smaller than the diameter of the pipe. Each die member 10 further has an annular beveled portion 24, extending from the gripping surface 20 to the front face 12 of the die member 10. During flaring the end of the pipe is pressed against this beveled surface by an eccentric cone 28 to create a flared portion 30. This is illustrated in FIG. 3. In the prior art die shown in FIGS. 1 and 2, there is typically a radius 25 between the front face of the die and the beveled portion 24. There is also a smaller inner radius 26 between the outermost of the threads 21 and the beveled portion 24. There may also be a flat transition region between the radius 26 and the first thread, the transition region being no wider than the width of two or three threads.

When a pipe is flared in a prior art die such as is shown in FIGS. 1 and 2 a stress concentration is created at the base 33 of the flared portion 30. During clamping and flaring of the pipe the gripping surface 21 will bite into the pipe 18. This creates cuts or grooves in the pipe. As can be seen from FIGS. 2 and 3, these grooves begin at the base of the flange 30, precisely in the region of the pipe where there is the greatest stress. The cuts or grooves create stress risers that increase the stress level and weaken the pipe in the region of the base of the flange.

Figure 4:
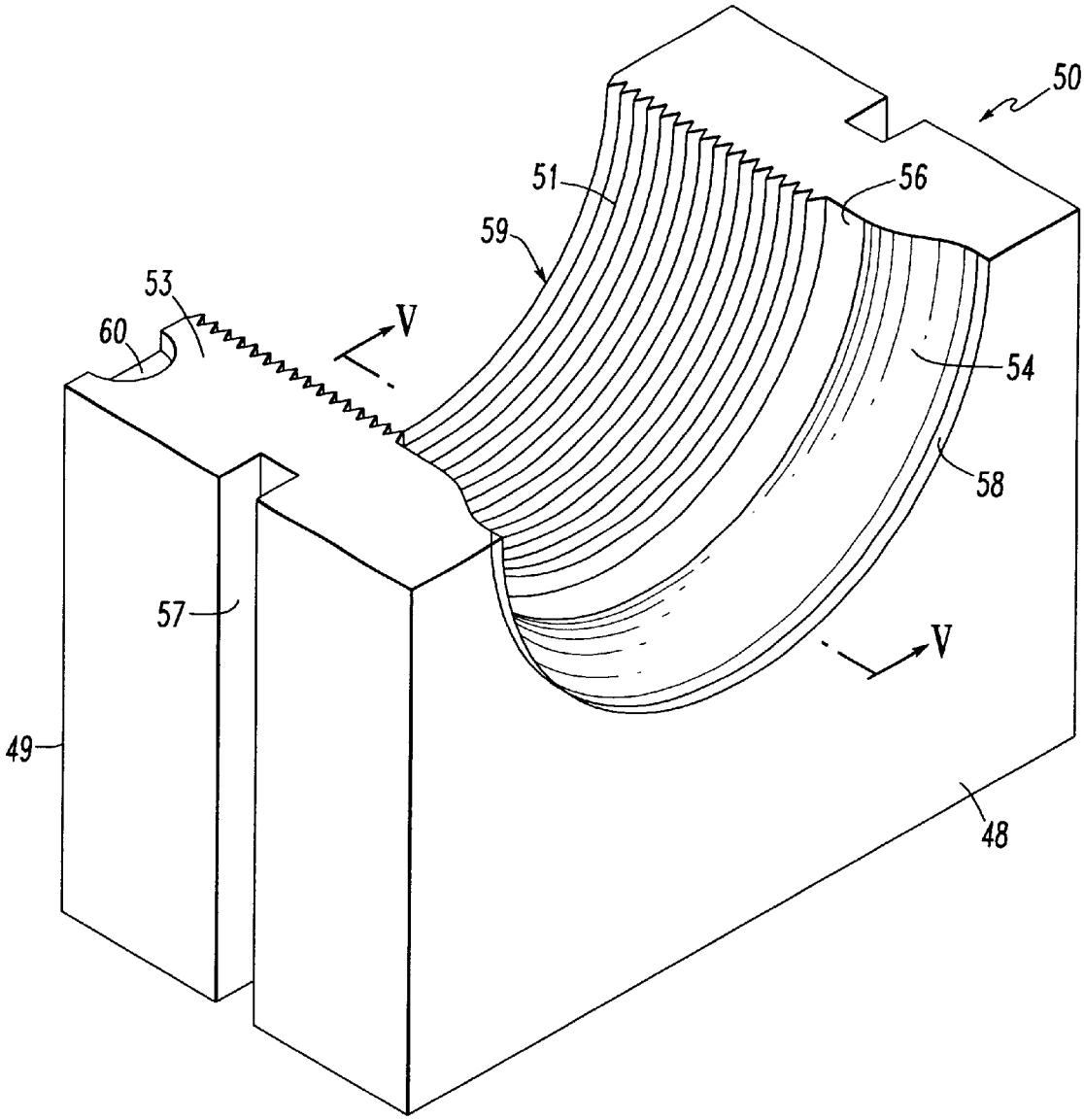
FIG. 4 is a perspective view of one-half of a flaring die according to a presently preferred embodiment of the invention.

A pipe flaring die member 50 according to the invention also consists of two arch shaped die members, one of which is shown in FIG. 4. The second die member is a mirror image of the die member that is illustrated in the drawing. Like the flaring dies of the prior art the die member 50 has a front face 48, a rear face 49 and a central opening 59 sized to receive a pipe 18. There are also slots 57 that are used to align the die in a clamping device. Similar to the prior art die members 10 described above, this pair of die members 50 are clamped together around the pipe 18 holding the pipe for flaring using a process as is illustrated in FIG. 3. When clamped together surfaces 53. on the shoulders of each die member will be opposite the same surfaces in the other die member. Like the prior art die members 10, the central opening 59 of each of the present die members 50 is sized slightly smaller than the radius of the pipe 18 to be gripped and flared. The present die members also have an annular gripping surface 51 containing ridges, threads or other projections 52 and a beveled portion 54. But in the present die the position of the gripping surface relative to the beveled portion is significantly different.

Figure 5:
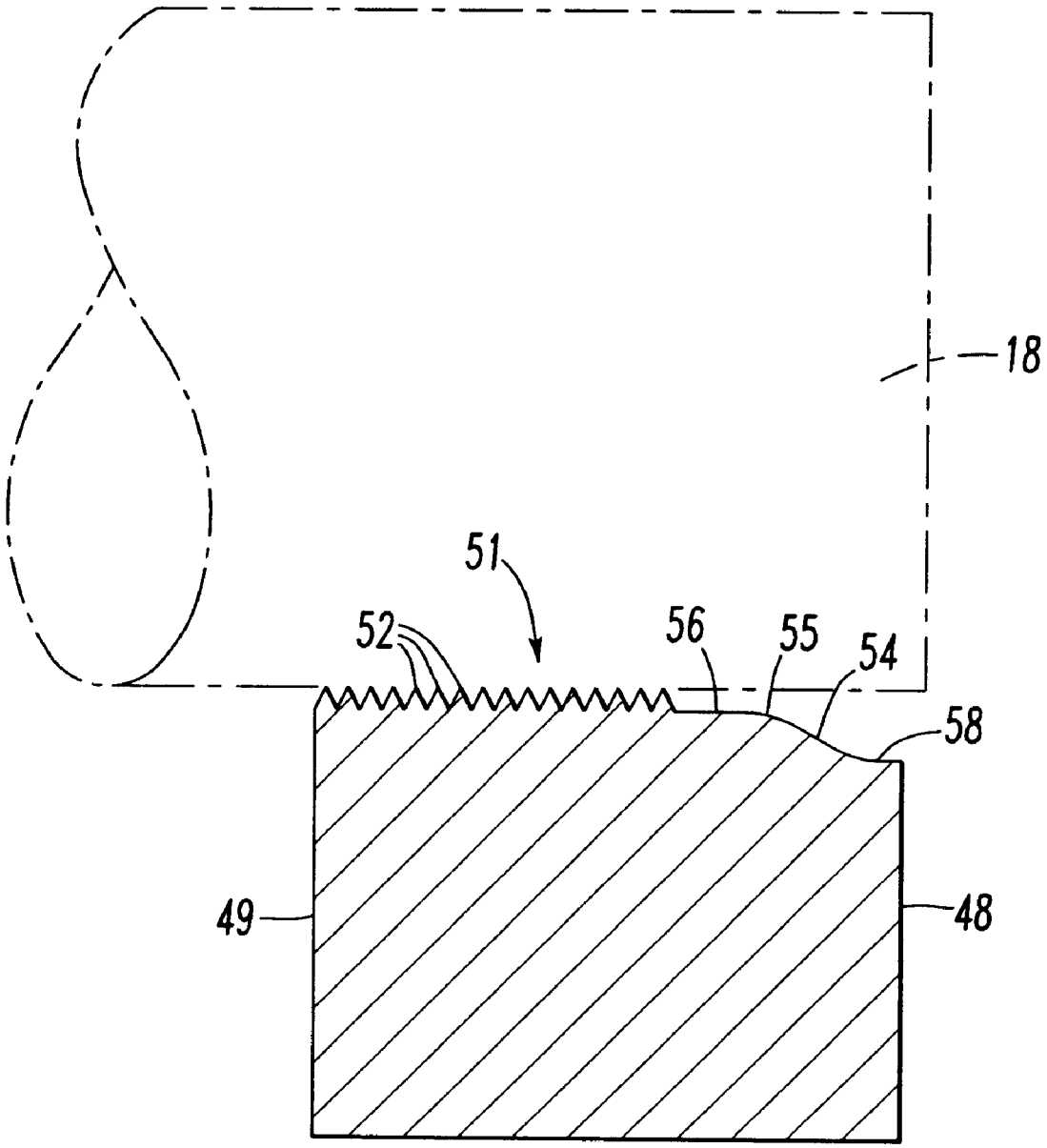
FIG. 5 is a sectional view taken along the line V—V in FIG. 4 with a portion of pipe shown in chain line.

As can be seen most clearly in FIG. 5, there is a transition or relief region 56 between the outermost thread of the gripping surface and the annular beveled portion 54. This transition region is much wider than the width of a few threads. Rather the transition or relief region is wide enough to move the cuts or grooves made in the outer surface of the pipe away from the base of the flared portion of the pipe when the most stress occurs in the pipe. In a preferred flaring die for a two inch pipe the width of the die is 1.625 inches wide, the gripping surface is 0.655 inches wide and the relief area is 0.475 inches wide. We prefer that the width of the relief area be at least two thirds of the gripping surface width or greater than the width of at least three projections on the gripping surface. We have discovered that the relief area 56 helps reduce and more widely distribute the stress imparted on the pipe 18 during the formation of the flared portion 30 The results of a stress analysis of pipes flared with a conventional die and pipes flared with a die having a relief portion revealed significantly less stress in the pipe flared with a die such as is shown in FIGS. 4 and 5. These results will be discussed in more detail below in connection with FIGS. 6 and 7. We further prefer to provide a radius 55 between the beveled portion 54 and the relief region 56. This radius results in a further reduction in the residual stress concentration at the base 33 of the flared portion 30 of the pipe 18.

We also prefer to provide a recess portion 58 between the beveled portion 54 and the front face 48 of the die member 50. This recess serves as a gauge for positioning the pipe in the die. The pipe fitter places a ruler or other straight edge across the face of the die and inserts the pipe until the pipe abuts the straight edge. Then he clamps the die around the pipe and flares the end of the pipe. Because of the recess the pipe will have been positioned so that there was a sufficient length of pipe in the die to create a flared portion of a desired size.

A further feature of the preferred embodiment is that one of the mating surfaces 53 of each of a pair of mating die members 50 can be provided with a recessed area 60. This recess 60 extends from the rear face 49, but could extend from the front face 48. After the two die members have been clamped together they may be difficult to separate after the flaring process is completed. The recess 60 is sized to receive the tip of a standard screwdriver. The die members can then be separated by inserting the tip of the screwdriver or other tool into the recess and turning the screwdriver to separate the clamped together die members. There can be one recess on one die member, or recesses on both die members. If both die members have a recess the recesses could be positioned to mate with one another or they could be positioned to mate with a flat surface on the mating die member.

Figure 7:
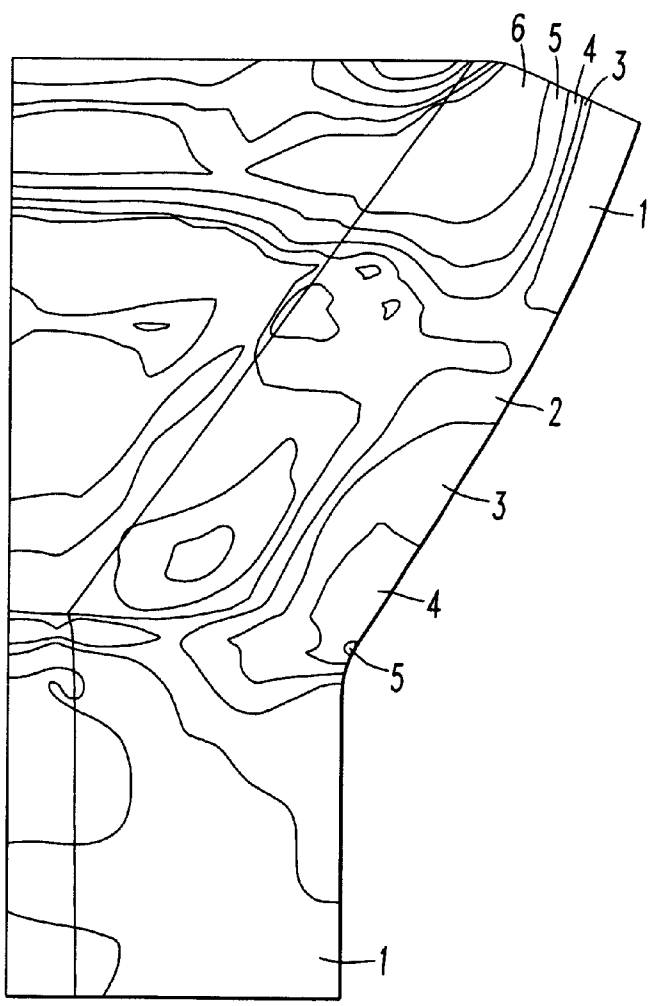
FIG. 7 is a cross-sectional view of a stainless steel pipe which has been flared by flaring die members such as shown in FIGS. 4 and 5 on which stress areas are identified.
Figure 6:
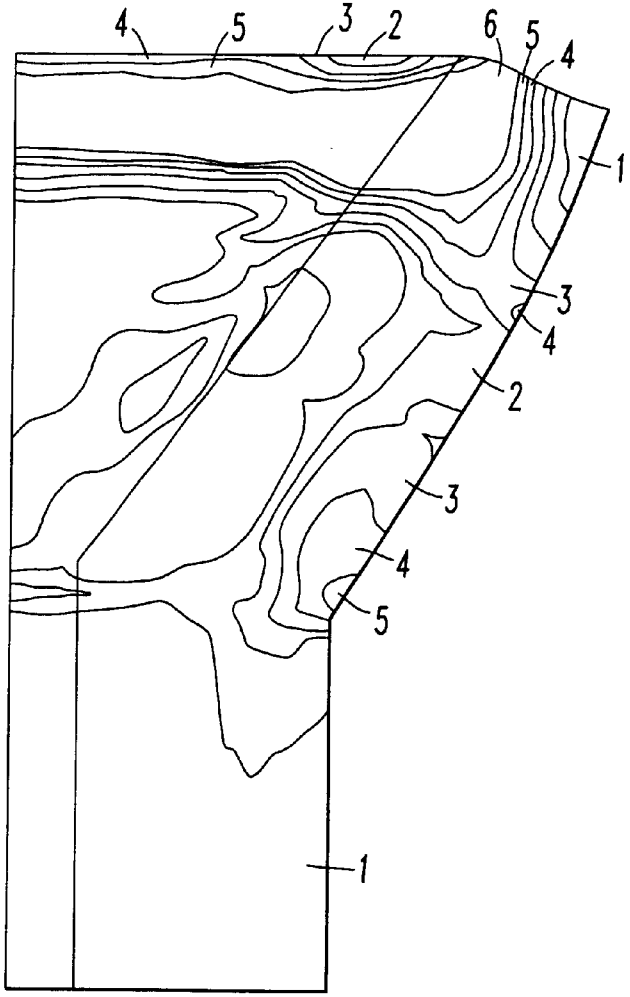
FIG. 6 is a cross-sectional view of a stainless steel pipe which has been flared using flaring die members such as shown in FIGS. 1 and 2 on which stress areas are identified.
Figure 9:
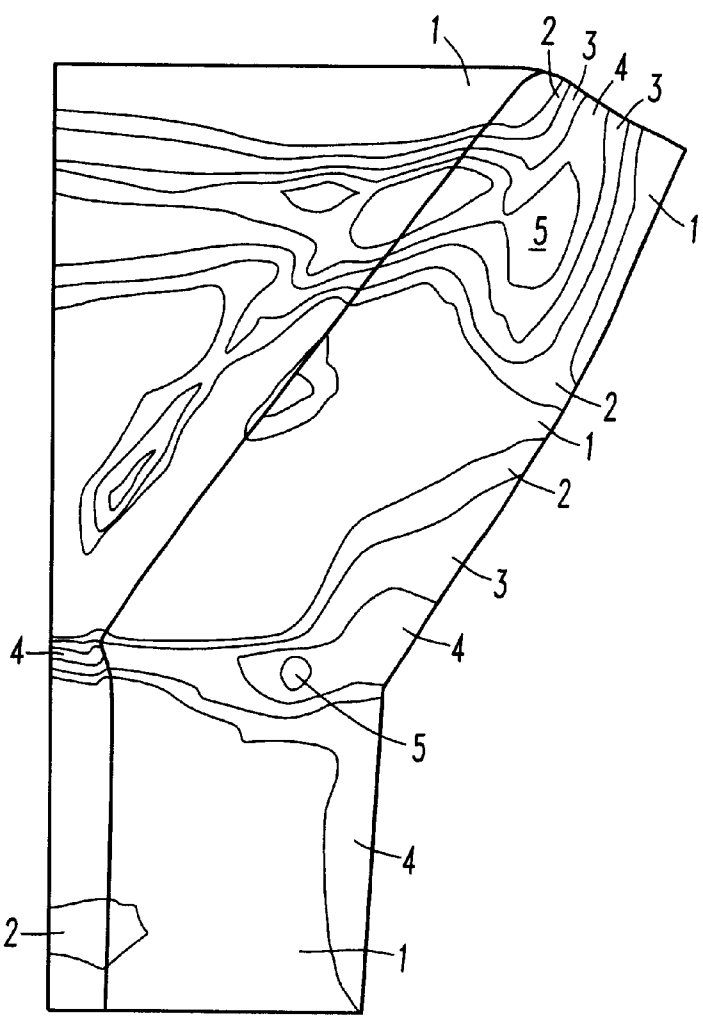
FIG. 9 is a cross-sectional view of a carbon steel pipe which has been flared by flaring die members such as shown in FIGS. 4 and 5 on which stress areas are identified.
Figure 8:
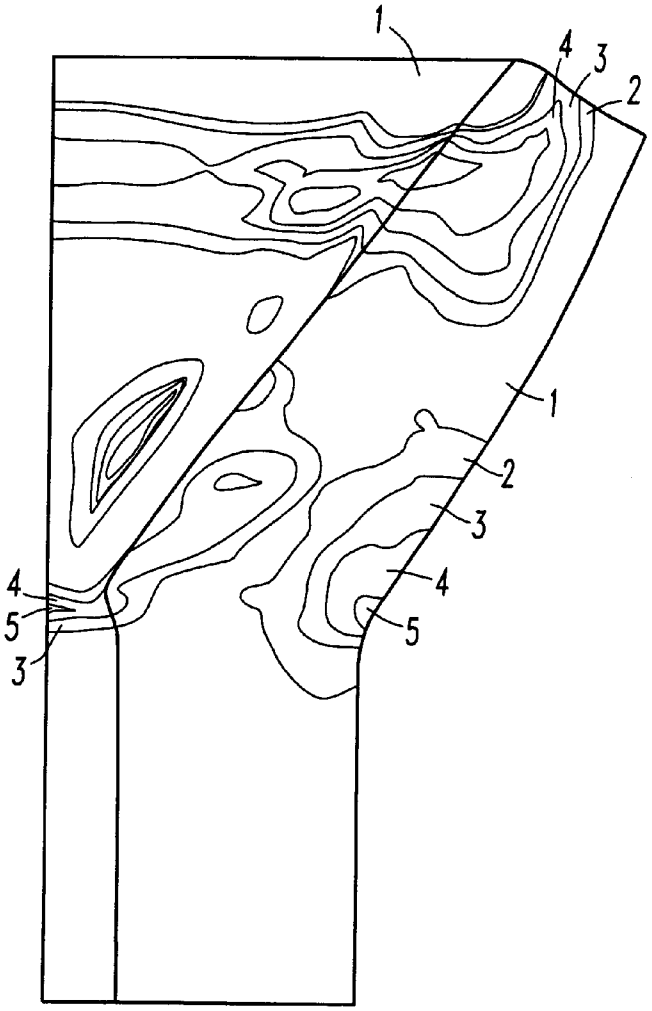
FIG. 8 is a cross-sectional view of a carbon steel pipe which has been flared using flaring die members such as shown in FIGS. 1 and 2 on which stress areas are identified.

Referring now to FIGS. 6, 7, 8 and 9 cross-sections of the flared end of the pipes 18*a*, 18*b*, 18*c* and 18*d* are marked to indicate stress concentrations derived using a finite element analysis method. Pipe 18*a* in FIG. 6 is one inch diameter stainless steel pipe formed using conventional die members. Pipe 18*b* in FIG. 7 is one inch diameter stainless steel pipe formed using die members according to the present invention. Pipe 18*c* in FIG. 8 is one inch diameter stainless steel pipe formed using conventional die members. Pipe 18*d* in FIG. 9 is one inch diameter carbon steel pipe formed using die members according to the present invention. In each figure the regions of the flared pipe are identified by reference numbers 1 to 6 according to a value of residual stress in that region. The higher the reference number the higher the residual stress. The reference numbers correspond to stress values according to the following table.

| Reference Number | Residual Stress |
|---|---|
| 1 | −2.22 E + 08 to 1.00 E + 08 |
| 2 | 1.00 E + 08 to 1.50 E + 08 |
| 3 | 1.50 E + 08 to 2.00 E + 08 |
| 4 | 2.00 E + 08 to 2.50 E + 08 |
| 5 | 2.50 E + 08 to 3.00 E + 08 |
| 6 | 3.00 E + 08 to 6.37 E + 08 |

There was a lower maximum tensile stress in the stainless steel pipe formed with the die of the present invention than the stainless steel pipe formed with a conventional die. The stress in the conventionally flared pipe was about 275 MPa compared to a stress of about 225 MPa for a pipe made the die shown in FIGS. 4 and 5. In the carbon steel pipe the maximum tensile stress at the base of the flared portion was reduced from 275 MPa, when formed using conventional die members to a maximum of 235 MPa, when formed using the die members 50. As can be seen from a comparison of FIG. 6 and 7 and FIGS. 8 and 9 the analysis also revealed that the relief area in the die of the present invention caused the tensile stress on the outer surface of the pipe 18*b* and pipe 18*d* to be spread further down the wall of the pipe and dispersed more radially inward than occurred in pipe 18*a* and pipe 18*c* made with a conventional die. There was a much greater difference in the carbon steel pipe 18*c* and 18*d*. The greater stress concentration in pipe 18*a* and pipe 18*c* made conventionally will cause that pipe to fail before the same pipe 8*b* or 18*d* made with a die in accordance with the present invention will fail. The reduction of the stress concentration at the base of the flared portion should extend the life of a joint to which the flared portion is connected. Furthermore, in a conventional die the surface of the pipe is cut by the clamping die in the region of greatest stress, further weakening the pipe. However, the cuts made by the die of the present invention are made in regions of lower stress. Therefore, a pipe flared with the die shown in FIGS. 4 and 5 will be much stronger and less likely to fail than a pipe flared with a conventional flaring die.

Although certain present preferred embodiments of the invention have been shown and described herein, it is to be distinctly understood that the invention is not limited thereto, but may be variously embodied within the full scope of the following claims.

We claim:

1. A pipe flaring die comprised of a pair of mating die segments, each die segment having a front face and a rear face, a pair of shoulders between the front face and the rear face, and a central portion extending from one shoulder to the other shoulder and between the front face and rear face such that when the die segments are mated together shoulder to shoulder, the central portions of the die segments define an opening sized to receive and grip a pipe to be flared. said central portion having:

a. an annular beveled portion adjacent said front face;

b. an annular gripping surface, the gripping surface having a plurality of projections each projection having a height and a width that enables the projections to bite into an outer surface of a pipe clamped between the mating die segments;

c. an annular relief area extending between said gripping surface and said beveled portion, said relief area having a width greater than a combined width of at least three projections said annular relief area being void of projections for biting into the outer surface of the pipe; and d. a radius at an intersection of said beveled portion and said relief area.

2. The pipe flaring die of claim 1 wherein said flaring die further comprises a pair of die members each having a semi-circular opening, said semi-circular opening of each of said pair of die members forming said central opening when said die members are clamped together, said semi-circular opening of each of said pair of die members having a diameter smaller than an outer diameter of a pipe to be held by the pipe flaring die.

3. The pipe flaring die of claim 2 wherein at least one shoulder has a recessed area extending to the front face or the rear face of the die segment and sized for insertion of a tool to separate said pair of die members after said pipe has been flared.

4. The pipe flaring die of claim 1 wherein the plurality of projections on said gripping surface comprising at least one of ridges and threads.

5. The pipe flaring die of claim 1 further comprising an annular recess portion between the front face of the flaring die and the annular beveled portion.

6. The pipe flaring die of claim 5 wherein the beveled portion has a width and the recess portion has a width so that a pipe placed in the flaring die so as to abut a plane passing through the front face of the die and flared will have a flange that has a width not less than the width of the beveled portion.

7. The pipe flaring die of claim 1 wherein the annular gripping surface has a width and the width of the annular relief area is about two thirds of the width of the gripping surface.

8. The pipe flaring die of claim 1 wherein the width of the annular relief area is not less than 0.4 inches.

9. A pipe flaring die comprised of a pair of mating die segments, each die segment having a front face and a rear face, a pair of shoulders between the front face and the rear face, and a central portion extending from one shoulder to the other shoulder and between the front face and rear face such that when the die segments are mated together shoulder to shoulder, the central portions of the die segments define an opening sized to receive and grip a pipe to be flared said central portion having:

a. an annular beveled portion adjacent said front face;

b. an annular gripping surface, the gripping surface having a gripping surface width and a plurality of projections each projection having a height and a width that enables the projections to bite into an outer surface of a pipe clamped between the mating die segments;

c. an annular relief area extending between said gripping surface and said beveled portion, said relief area having a width said annular relief area being void of projections for biting into the outer surface of the pipe of at least two thirds of the gripping surface width; and d. a radius at an intersection of said beveled portion and said relief area.

10. The pipe flaring die of claim 9 wherein said opening sized to receive and grip a pipe has a diameter smaller than an outer diameter of the pipe to be received and gripped by the pipe flaring die.

11. The pipe flaring die of claim 10 wherein at least one shoulder has a recessed area extending to the front face or the rear face of the die segment and sized for insertion of a tool to separate said pair of die members after said pipe has been flared.

12. The pipe flaring die of claim 9 further comprising an annular recess portion between the front face of the flaring die and the annular beveled portion.

13. The pipe flaring die of claim 12 wherein the beveled portion has a width and the recess portion has a width so that a pipe placed in the flaring die so as to abut a plane passing through the front face of the die and flared will have a flange that has a width not less than the width of the beveled portion.

14. A pipe flaring die comprised of a pair of mating die segments, each die segment having a front face and a rear face, a pair of shoulders between the front face and the rear face, and a central portion extending from one shoulder to the other shoulder and between the front face and rear face such that when the die segments are mated together shoulder to shoulder, the central portions of the die segments define an opening sized to receive and grip a pipe to be flared said central portion having:

a. an annular beveled portion adjacent said front face;

b. an annular gripping surface, the gripping surface having a gripping surface width and a plurality of projections each projection having a height and a width that enables the projections to bite into an outer surface of a pipe clamped between the mating die segments;

c. an annular relief area extending between said gripping surface and said beveled portion, said relief area having a width of at least 0.4 inches said annular relief area being void of projections for biting into the outer surface of the pipe; and d. a radius at an intersection of said beveled portion and said relief area.

15. The pipe flaring die of claim 14 wherein said opening sized to receive and grip a pipe has a diameter smaller than an outer diameter of the pipe to be received and gripped by the pipe flaring die.

16. The pipe flaring die of claim 15 wherein at least one shoulder has a recessed area extending to the front face or the rear face of the die segment and sized for insertion of a tool to separate said pair of die members after said pipe has been flared.

17. The pipe flaring die of claim 14 further comprising an annular recess portion between the front face of the flaring die and the annular beveled portion.

18. The pipe flaring die of claim 17 wherein the beveled portion has a width and the recess portion has a width so that a pipe placed in the flaring die so as to abut a plane passing through the front face of the die and flared will have a flange that has a width not less than the width of the beveled portion.

* * * * *